US005817215A

United States Patent [19]

Kinnunen

[11] Patent Number: 5,817,215

[45] Date of Patent: Oct. 6, 1998

[54] ASSEMBLY FOR A PAPER WEB COATING LINE AND A METHOD FOR TAIL THREADING

[75] Inventor: Jorma Kinnunen, Järvenpää, Finland

[73] Assignee: Valmet Corporation, Helsinki, Finland

[21] Appl. No.: 649,728

[22] PCT Filed: Nov. 29, 1994

[86] PCT No.: PCT/FI94/00537

§ 371 Date: Jul. 11, 1996

§ 102(e) Date: Jul. 11, 1996

[87] PCT Pub. No.: WO95/14816

PCT Pub. Date: Jun. 1, 1995

[30] Foreign Application Priority Data

Nov. 29, 1993 [FI] Finland ..... 935321

[51] Int. Cl.[6] ..... D21F 7/00

[52] U.S. Cl. ..... 162/193; 162/286; 118/641; 118/643; 118/58; 118/67; 118/68; 226/91; 242/532.7; 242/562.1

[58] Field of Search ..... 118/641, 643, 118/58, 67, 68, 239; 242/562.1, 532.7; 226/91; 162/286, 193

[56] References Cited

U.S. PATENT DOCUMENTS

| | | | |
|---|---|---|---|
| 2,764,068 | 9/1956 | Sutherst | 162/193 |
| 3,096,233 | 7/1963 | Rappaport et al. | 162/193 |
| 4,728,396 | 3/1988 | Alheid | 226/91 |
| 5,087,325 | 2/1992 | Page | 162/193 |
| 5,547,509 | 8/1996 | Neider et al. | 118/68 |

FOREIGN PATENT DOCUMENTS 0427887 5/1991 European Pat. Off. .

*Primary Examiner*—Laura Edwards
*Attorney, Agent, or Firm*—Cohen, Pontani, Lieberman, Pavane

[57] ABSTRACT

An apparatus to facilitate tail threading of a paper web and a method of threading the tail of a paper web (1) to be coated through a coating line during startup or web break, in which an edge strip is slit from the web to act as the tail of the web which is first threaded through the line and then widened to the normal width of the web by moving the edge strip slitter. Said edge strip is first guided to a movable support element (12) located after the edge strip slitting point in the travel direction of the web (1) and the strip is supported against said movable support element (12) and is passed supported by said movable support element (12) to the next support element (14). A guiding/auxiliary support element (31) is brought to the discontinuity points of web support path and the edge strip is passed with the help of said auxiliary support element over the discontinuity and the edge strip is passed through the entire coating line supported by said sequential support elements (2, 12, 14, 18, 19, 22, 25) and said guiding/auxiliary support elements (31).

20 Claims, 5 Drawing Sheets

ASSEMBLY FOR A PAPER WEB COATING LINE AND A METHOD FOR TAIL THREADING

FIELD OF THE INVENTION

The present invention is related to an assembly for a paper web coating line for guiding a paper web in a coating line.

The invention also concerns a method for threading the web tail through a coating line or coater section.

BACKGROUND OF THE INVENTION

In modern paper finishing lines, the web conventionally is passed under the guidance of different kinds of rolls through coater stations and dryer sections. Upon a web break or at the startup of the equipment, a narrow edge strip is slit from the web and then the strip is blown into a nip formed by ropes running beside the web, whereby the strip will be threaded through the coating line in the rope carrier nip. During running, the web is subjected to a high stress particularly at a coater station where the situation is further complicated by the increasing moisture content of the web. As a thin base web caliper is today preferred and the goal is to increase the use of recycle fiber as the paper raw material, the web is sensitive to high stress loads. The low strength of the web easily results in web breaks, whereby the situation is termed as critical runnability of the base web. The fragility of the web requires extremely good control of web tension and speed differentials, whereby the implementation of the control and adjustment system of the paper machine section becomes complex and the running of the equipment requires careful operation to achieve top efficiency.

As the fastest paper machines designed for coated grades are run in the production of light-weight printing grades obviously having a low-weight base web, the risk of web breaks is highest particularly in fast machines where web breaks obviously have greatest impact on profitability. Today, the fastest paper machines are run at web speeds of 1200–1500 m/min. Then, the on-machine coating line must cope with the web speed of the paper machine, and additionally, the coating line must provide a reliability figure of at least the same order as that of the paper machine. In an off-line machine, the web speed must be 10–15% higher than the maximum speed of the paper machine to prevent the coating line from forming the bottleneck at the mill. As the base paper sheet may have a basis weight of as small as 35–55 g/m$^2$, running the moist web exiting the coater without web breaks becomes extremely difficult at these speeds.

During a web break the web tail must always be threaded through the entire paper machine section, and only after a successful tail threading, can the web be extended to its normal width. Tail threading occurs in such a manner that a narrow edge strip called the tail is slit from the web edge and guided by means of air jets into a nip formed by ropes running beside the web serving to thread the web tail through the line, after which the web is extended to its full running width by moving the edge strip slitter across the web. Guiding the edge strip into the rope nip is extremely difficult as the tail is subjected to a very high resistance by still-standing air at these machine speeds. Because the edge strip in practice has no stiffness, controlling it into the nip against the resistance of ambient air is cumbersome and requires precise support using the guiding air jets. The standard practice of tail threading at full web speed in contemporary machines occurs by blowing the edge strip into the rope nip and repeating the tail threading operation as many times as is required to successfully complete the blowing step into the rope nip and the tail threading step. As up to several tens of such attempts may be needed for each web break, it is obvious that during a web break substantial amounts of broke must be returned to the pulper and the duration of the web break is prolonged, whereby both of these shortcomings essentially reduce the operating efficiency of the line. Naturally, the advantage offered by a higher machine speed remains smaller than expected if the number of web breaks is high and the duration of the breaks is long.

It is thus evident that contemporary threading arrangements cannot be used any more if the machine speed is essentially elevated from current speeds, that is, to the very-high-speed range. The lower limit for the very-high-speed range is taken as 1800 m/min, while the design target is set as high as 2500 m/min. Obviously, the moist web exiting from a coater cannot be run in current machines at such high speeds in any case. As the air resistance increases in proportion to the second power of speed, the conventional method of tail threading will not be possible in practice. To achieve high efficiency at the high-speed range, the number of web breaks should be kept to the minimum. Also the tail threading step should go essentially smoother than today in order to keep web break downtimes and the amount of broke at a reasonable level. A rapidly moving web invokes an air flow travelling along with the web surface resulting in the entry of the air flow between the guide and pull roll, whereby disturbance and quality impairment will occur at the coater if the air is allowed to gain access between the backing roll and the web or to the application zone. Such problems are heavily accentuated with higher web speeds and concomitant increase of air resistance. The air flow induces oscillation of the web and thus increases the risk of web breaks.

As the strength of the web against stress is weakest immediately after the coat application step when the moisture content of the web has increased, attempts have been made to reduce the stresses imposed on the web by means of noncontacting web guidance. In this arrangement the web is passed between air jet cushions blown against the web from the opposite sides of the web, and the travelling direction of the web is altered by means of deflectors adapted to blow an air cushion between the web and the deflector. However, such a noncontacting arrangement is presently still hampered by several drawbacks. Namely, the web tension in this arrangement must in any case be controlled by the speed differentials of the pull rolls. Consequently, web tension control and smoothing of web tension variations remains as critical and clumsy as in roll-guided arrangements. In fact, variations in web tension form the main reason for web breaks. Implementation of tail threading in the air-jet guided arrangements is also difficult and the control of the web travel in the high-speed range would require an air-jet system of extreme precision. Such a web support system is therefore not a viable solution to the problems of web travel control or tail threading in high-speed paper machine applications.

SUMMARY OF THE INVENTION

It is an object of the present invention to achieve such an assembly in which the number of web breaks can be essentially reduced, particularly in the high-speed range, with a simultaneous improvement of the tail threading step.

The present invention is based on passing the web through the entire coating line up to the winder essentially supported by a wire or similar belt-like element.

More specifically, the assembly according to the present invention comprises a coating line in which the paper web is supported essentially along its entire path in the coating line by a plurality of belt-like support elements.

Furthermore, the method according to the present invention comprises threading the tail of a paper web to be coated through a coating line so that the tail is supported essentially along its entire path in the coating line by a plurality of belt-like support elements.

The present invention offers significant benefits.

By virtue of supporting the web along its travel through the entire length of the paper machine section with the help of a wire, the number of web breaks can be essentially reduced. In a wire-supported web, the transient speed variations causing changes in web tension are transmitted to the web-supporting wire, whereby variations of web tension causing web breaks in conventional arrangements are eliminated, thus removing this origin of web breaks. As the web travels continuously supported, its vibrations are damped which further lowers the hazard of web breaks. The amount of air travelling along with the web is drastically reduced as the travelling air film can form on one side of the web only. The amount of air travelling along with the web on its other side is reduced by air jets impinging on the web in the air-jet dryer units and suction boxes with their suction slots facing the wire. Each side of the web travels only for a short length in the open air, thus preventing the occurrence of a high-speed air film travelling along with the web surface. This property contributes essentially to the supporting and coating of the web.

At a web break, the wires move the web resting thereon forward in the paper machine section thus facilitating easy removal of the broke to the pulper at any suitable point. Hence, the coating line can be made self-clearing, whereby the downtime due to web break is essentially shortened and the hazardous broke clearing step can be eliminated. The tail threading step becomes easy to implement as the edge strip can be transported through the entire paper machine section supported by the wires, whereby the wires provide continuous support to the web, and the edge strip has no chance of breaking or deflecting sideways. Further, the edge strip need not be fed into a separate rope carrier nip or other transport arrangement, which would be an almost impossible operation in the high-speed range. As the edge strip travels in the paper machine section during the tail threading step in the same manner as the web proper under normal operation, the tail threading step will occur safely even in the high-speed range, and no speed reduction is necessary during tail threading. This brings about an essential improvement in the operating efficiency of the apparatus.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
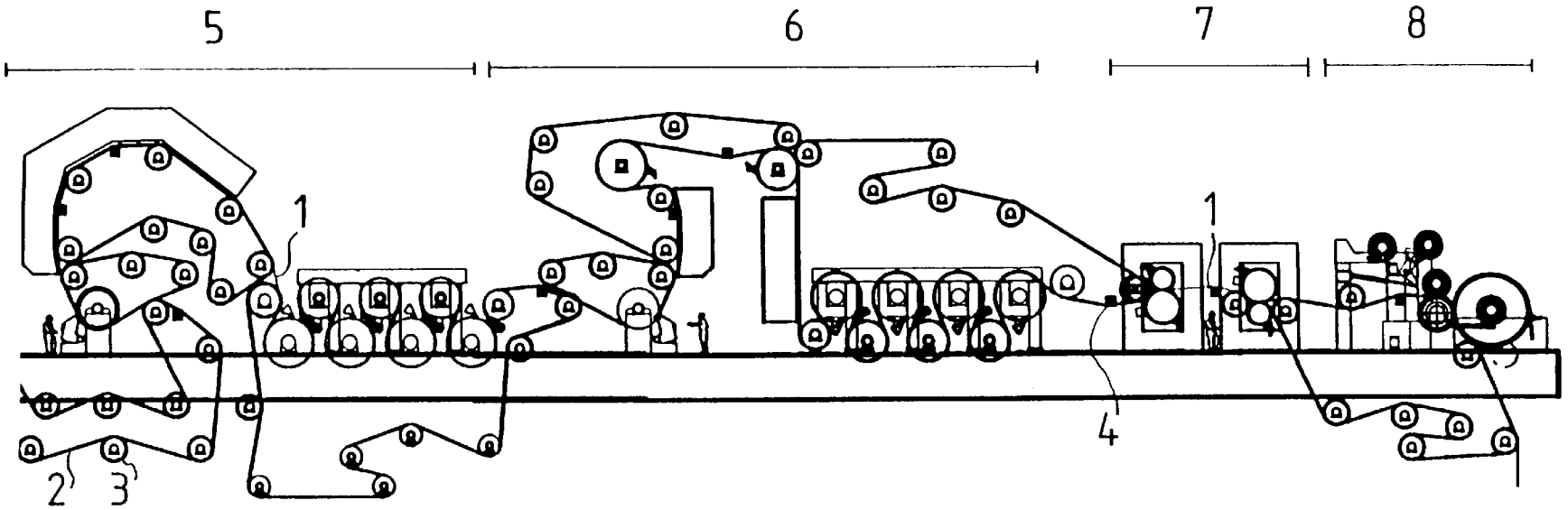
FIG. 1 is a diagrammatic side view of a coating line implemented using the assembly according to the present invention.

In the following text, the term "wire" denotes any woven, air-permeable support element, and the term "belt" denotes any non-air-permeable, flat support element. These terms are used only for reasons of clarity and must not be understood to limit either of the support elements to any specific technical embodiment.

With reference to FIGS. 1–4, a layout of a coating line is illustrated suitable for an advantageous implementation by means of the assembly according to the present invention. This layout comprises an on-machine coating line in which the paper web 1 is passed to the coating line directly from the paper machine with the help of a delivering wire 2. The delivering wire 2 is driven and guided by means of rolls 3. The layout of the line comprises two coater stations 5, 6 with their dryers, a calender 7 and a winder 8. In this coating line layout a single coat is applied to both sides of the web and the coated web is calendered and finally wound into a roll.

Figure 2:
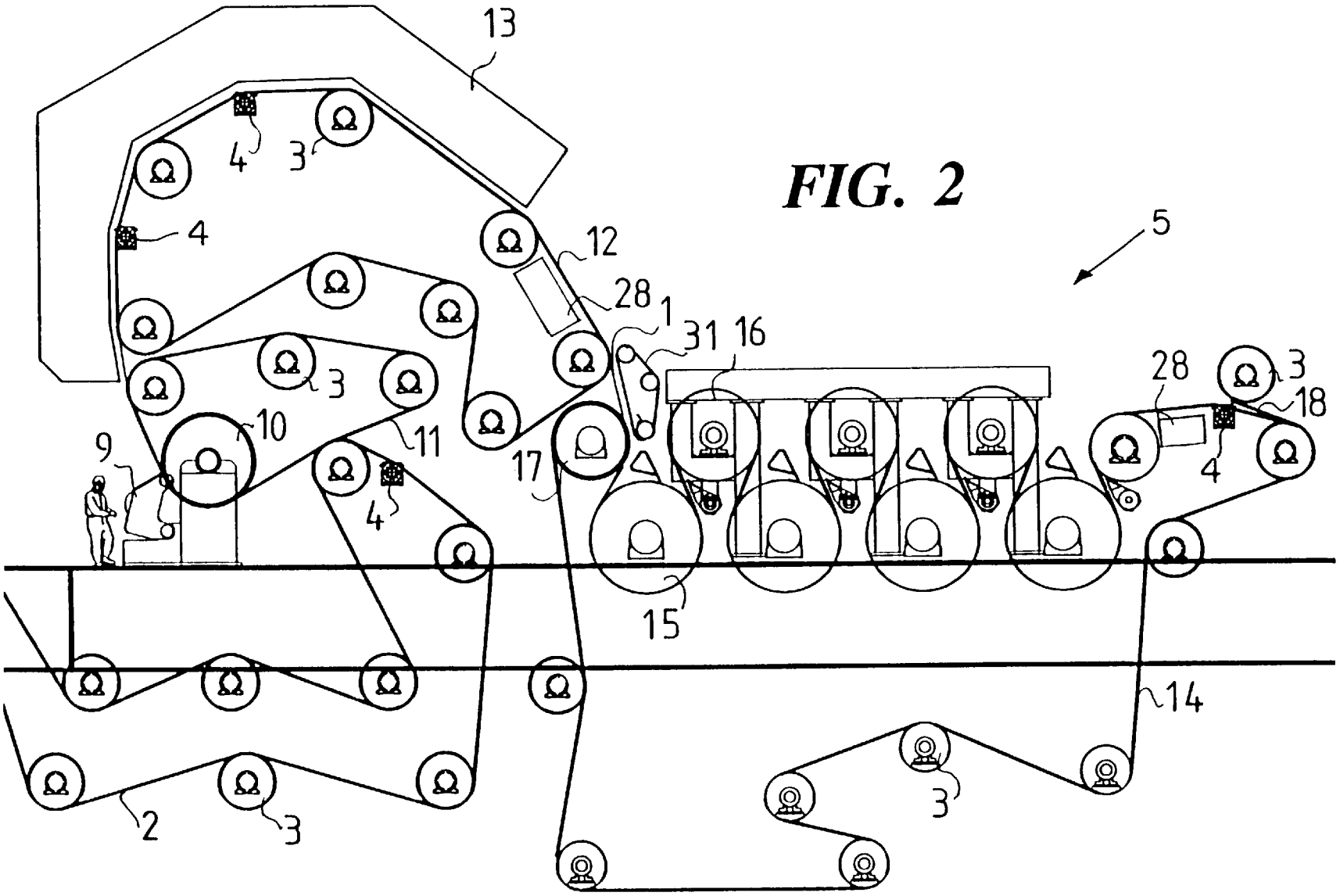
FIG. 2 is an enlarged side view of the first coater unit of the coating line shown in FIG. 1 with the dryers.
Figure 3:
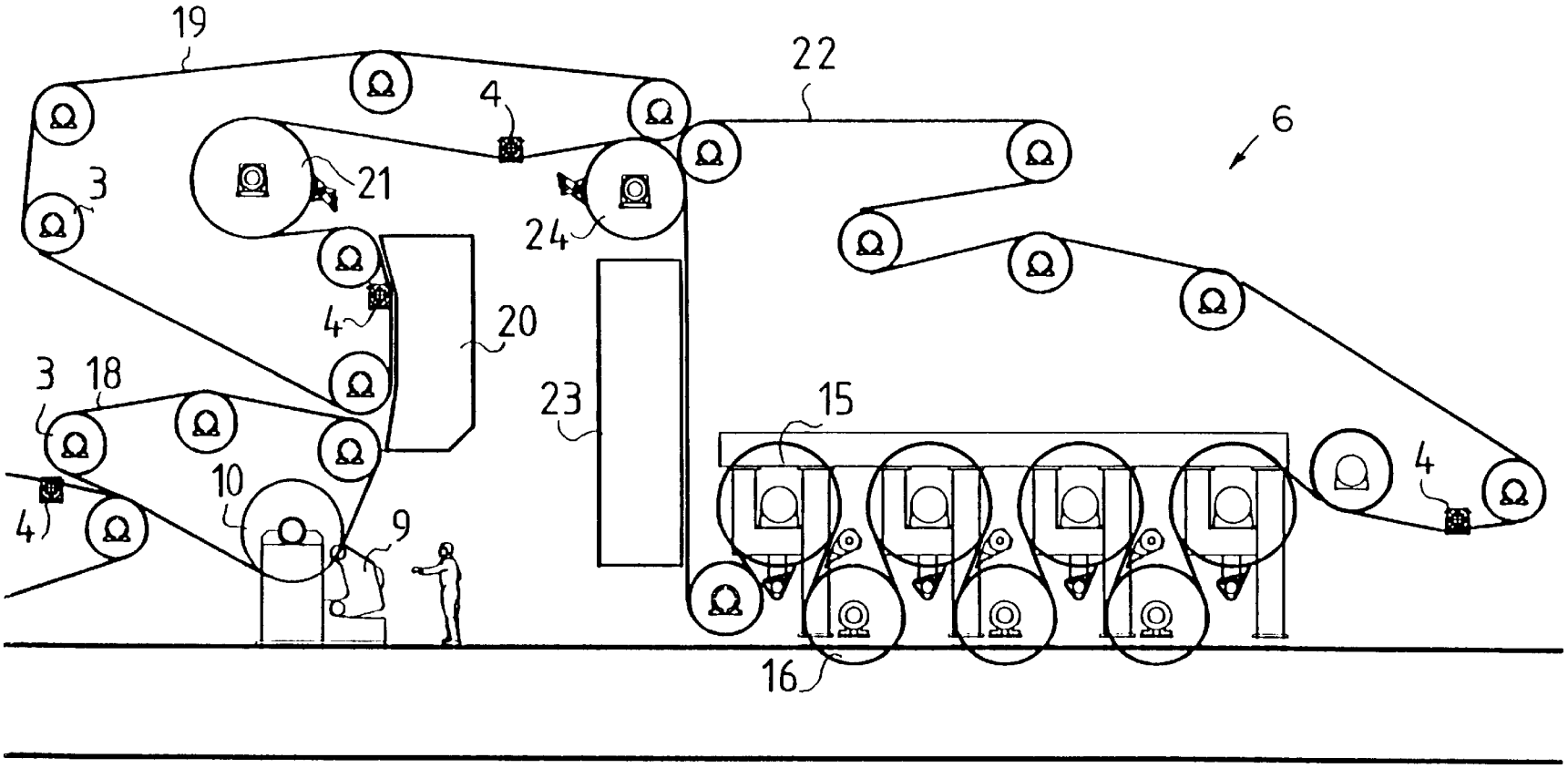
FIG. 3 is an enlarged side view of the second coater unit of the coating line shown in FIG. 1 with the dryers.
Figure 4:
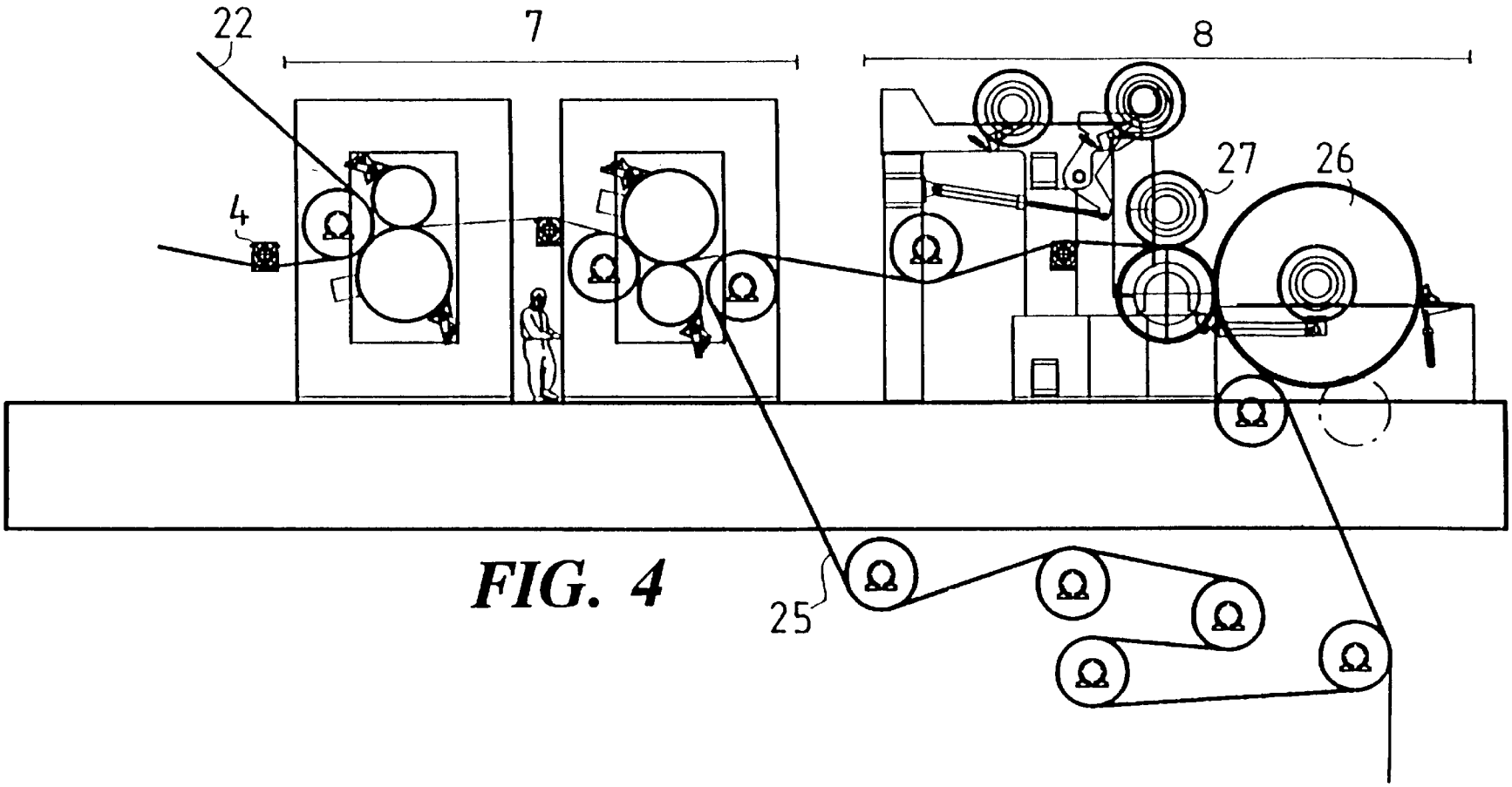
FIG. 4 is a side view of exit end calender and winder of the coating line shown in FIG. 1.

The different parts of the machine layout and the parts therein comprising the assembly according to the present invention are illustrated in the enlarged views of FIGS. 2–4. With reference to FIG. 2, the first coater station is shown. The coater station comprises a coater unit 9, an air dryer 13 used for predrying of the web and a dryer cylinder group 15, 16 used for afterdrying. The coater unit 9 includes an endless belt 11 adapted to pass over a backing roll 10 of the coater unit, past the application zone of the coater unit 9 and the backing roll 10. The belt 11 is guided by guide rolls 3. Coating in this kind of apparatus takes place against the belt 11. Also the predryer unit of the dryer section includes a support wire 12 formed into an endless loop by means of guide rolls 3. Two spreader roll units 4 are arranged pressing against the support wire 12. To the proximity of the support wire 12 is placed air dryer units 13 blowing drying air against the wire 13 and the web 1 running thereon.

After the predryer unit is located an afterdryer unit which in the illustrated layout comprises suction rolls 15 and heated steam rolls 16. Over the rolls 15, 16 is arranged to pass a support wire 14 adapted to run as an endless loop about guide rolls 3. Between the dryer cylinder group 15, 16 and the predryer unit is placed a receiving roll 17 about which the support wire 14 also passes. After the cylinder group 15, 16 is a spreader roll unit 4 pressing against the wire.

Figure 5:
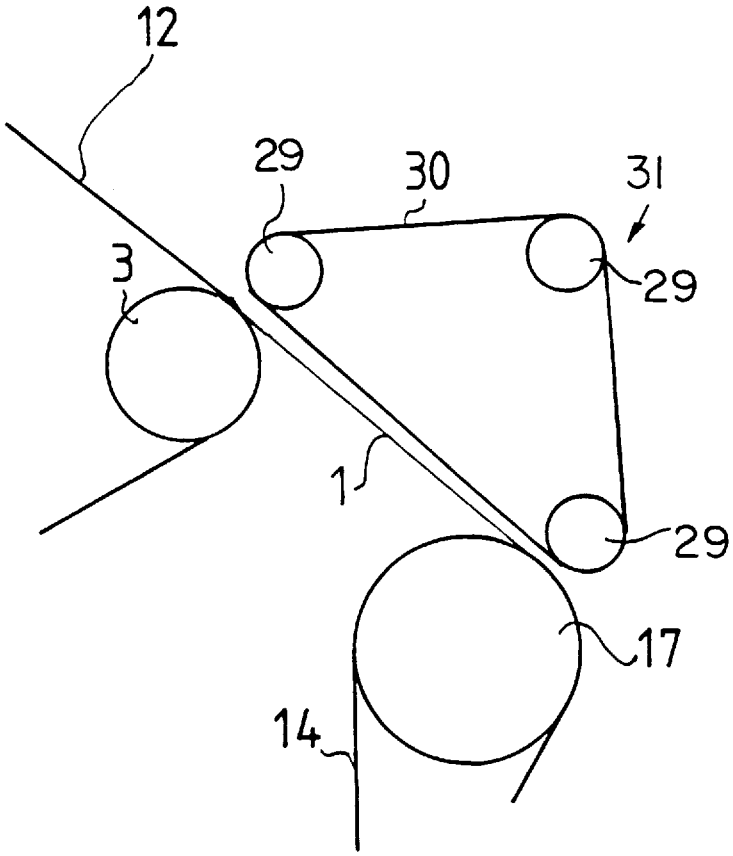
FIG. 5 is a side view of an apparatus suited for guiding the edge strip of the web at a discontinuity point of the wire support assembly.

To achieve smooth passing of the edge strip over the discontinuity points of web support arrangement as the edge strip jumps from one wire to the next, the discontinuity point can be provided with a guidance device 31, e.g., such as one shown in FIG. 5. This device is comprised of three rolls 29 adapted in a triangle and guide band 30. Two of the rolls 29 form together with the band 30 a support surface which extends from the edge strip delivering roll 3 to the receiving roll 17. When the guidance device 31 is placed at the discontinuity point of the support arrangement, it provides support for the edge strip during the tail threading operation. While the guidance device could be placed permanently to the discontinuity point, in practice it is made transferrable, whereby the guide belt 30 is moved to the discontinuity point only for the duration of the tail threading operation. One of the rolls in the guidance device can be a pull roll, or alternatively, the guide belt 30 can be adapted to press against the support wires 12, 14 so as to make them drive the guide belt directly. The guidance device can further be provided with suction/blowing arrangements to assure the stay of the edge strip on the guide belt.

Referring again to FIG. 2, function of the coating step and the travel of the web in the coater station of the above-described layout is as follows: Carried on the delivering wire 2, the web 1 to be coated enters onto the support belt 11 of the coater unit 9. The delivering wire 2 presses the side of the web not facing the wire 2 against the support belt 11, and the web 1 is transferred to travel on support belt 11. Thus, the web 1 is provided with support also at the discontinuity of its path from one support element to another. Running on the support belt 11, the web 1 passes over the backing roll 10 of the coater unit 9 to the application zone, where the exposed side of the web 1 not facing the support belt 11 is coated and smoothed using a suitable amount of coating mix. After coating, the web 1 is passed onto the support wire 12 of the predryer section. As one side of the web 1 is now moist, the web 1 must enter onto the support wire 12 so that the moist side of the web 1 will not be facing the support wire 12. Hence, a similar contacting transfer from one support element to the next cannot be used as that between the delivering wire 2 and the support belt 11 of the coater unit 9. Accordingly, the web 1 must be transferred unsupportedly from the support belt 11 onto the support wire 12. However, the unsupported travel has been kept to a minimum length, thus avoiding large stresses on the web 1 at this discontinuity.

After coating, the web 1 tends to widen, whereby it requires cross-machine tensioning to keep the web 1 adequately supported. The cross-machine tensioning, or spreading, of the web l is accomplished by tensioning the support wire 12 with the help of specially-designed spreader rolls 4. The spreader rolls 4 may comprise, e.g., roll units formed by short rolls aligned in the shape of an arc. Such spreader units are well known in the art. Pressing against the support wire of the predryer of the first coater station 5 are two spreader units 4, which are displaced at a distance from each other in the machine direction of the wire. To achieve spreading of the web 1 by means of the support wire 12, the wire structure must be such that it permits sufficient spreading of the wire by means of the spreader units 4 and subsequent contraction of the wire to its initial width during one cycle of its path.

Predrying in this embodiment is accomplished by means of air dryers 13 which press the wire 1 against the support wire 12 and provide drying of the web surface to touch-dry.

Subsequent to predrying, the web 1 has a touch-dry surface and it can be passed onto a support wire 14 of the cylinder dryer unit. Also here, web transfer takes place without changing the supported side, whereby the web 1 travels over a short gap unsupportedly. The web 1 being transferred enters onto the support wire 14 of the cylinder dryer unit over a receiving roll 17. Next, the wire 1 and the support wire 14 pass to a first suction roll 15, where the support wire 14 is turned so that the web 1 passes into the nip between the wire 14 and the suction roll 15. From the suction roll 15 the web 1 and the wire 14 pass onto a heated steam roll 16, where the web 1 wraps outermost about the roll 16. The heat imparted by the steam roll 16 further removes more water from the web 1. After the web 1 has passed the entire cylinder dryer unit, it is dry and is taken to the next coater station 6 for coating the other side of the web 1. Prior to the transfer of the web 1 onto the next support element, both the web and the wire are once again spread by means of a spreader unit 4.

Referring now to FIGS. 1 and 3, web transfer onto the support belt 18 of the second coater station 6 occurs in the same manner as the web transfer from the delivering wire 2 to the support belt 11 of the first coater station. The coater unit 9 of the second coater station and the path of the support belt 18 are arranged in the same manner as in the first coater station. By contrast, the predryer unit and its support wire 19 have a different arrangement. The transfer of the web 1 takes place as described above without a change of the supported side of the web 1. In the travel direction of the web 1, immediately after the web 1 leaves the support belt 18 of the coater unit, a first air-jet dryer 20 is located which presses the web 1 against the support wire 19. To the opposite side of the support wire 19 is placed a spreader unit 4. From the first dryer 20 the web 1 and the wire 19 pass onto a large-diameter turning roll 21 on which the direction of the web 1 and the wire 19 is turned. Following the turning roll 20 is placed a second spreader unit 4 and a web guide roll 24. After the predrying unit the support wire 19 tangentially passes over the web guide roll 24 and the web is transferred on the guide roll 24 onto a support wire 22 of the second dryer cylinder group 15, 16 as the support wire tangentially meets the guide roll 24. In this manner the web 1 can be transferred from one wire to the next continuously supported without the need for a change of the supported side of the web. A precondition to such an arrangement of web transfer from one wire to the next is that the coat is dried in the dryer 20 to touch-dry before the coated surface of the web is turned against the turning roll 21 or the web guide roll.

The support wire 22 of the dryer cylinder group transfers the web past a second air dryer 23 which completes the predrying, after which the web 1 is passed to the dryer cylinder group 15, 16. From the dryer cylinder group the web 1 is passed to a calender 7 as shown in FIGS. 1 and 4. From the calender 7 the web is passed onto a support wire 25 of a winder 8 where the web is transferred on the wire to a roll 26 being wound in the winder. The winder 8 is designed for continuous operation and roll change occurs by bringing an empty core shaft 27 from a storage position close to the support wire 25 and then striking in the shaft against the web 1. The web 26 being wound onto a full roll 26 is cut and the web 1 is guided to wind about the empty core shaft 27 which is then transferred to the winder station from which the full roll 26 has been removed.

Different requirements are set for the support elements used in the assembly. The support wires must have a spreading capacity to provide, under the effect of the spreading rolls, sufficient compensation against the spreading of the web and yet be capable of acquiring their initial width during one cycle of wire travel. Furthermore, the wires must have high air penetration to permit removal of water also through the wire and adherence of the web to the wire by means of a vacuum applied to the wire. Such web adherence to the wire is extremely important, and it is assured with the help of compressed-air jets impinging on the web, suction rolls and suction boxes 28 placed behind the support wires. In FIG. 2 the suction boxes are shown only diagrammatically as their construction is well known in the art thus obviating their detailed description herein. Besides and instead of air-jet-based support arrangements, mechanical support means can be used.

The support belts used in the coaters must have a very smooth surface to keep the coat profile impeccably level.

Hence, the support belt material must have a smooth surface or maximally containing small-diameter micropores. While adherence to such a belt cannot be arranged by a vacuum, additional support can be provided where necessary by air-jets, and prior to coat application, also mechanically. However, in practice the web being coated tends to adhere relatively strongly to the surface of the smooth support belt by static electricity, and after coat application, adhesion caused by the moisture of the web, whereby additional support is not necessarily needed.

At a web break, the web is cut in a conventional manner, and the web is guided to the pulper at a suitable point along the line. By their continuous running, the support belts and wires automatically clear the line free of broke, and after the disturbance is rectified, new tail threading can be made. When the tail threading is commenced, an edge strip is cut from the web and controlled by means of, e.g., an air jet to the wire, on which it will be adhered by virtue of a vacuum or blown air. At the discontinuity points of the web path, such as the ends of the support belts of the coaters and the support wires of the predryers, are brought auxiliary support belt devices which guide the edge strip over a discontinuity to the next support element. The edge strip is transferred forward continuously supported by some support element, whereby its breaking during tail threading is avoided. After the edge strip is successfully threaded through the entire line, the edge strip slitter is moved across the web so as to extend the web to its normal width. Accordingly, the tail threading is accomplished in an extremely reliable manner as the supported edge strip cannot break and is easy to guide even at high web speeds to the wide support element.

The assembly according to the present invention can be adapted to almost any coating line layout. Difficulties are encountered only in two-sided coating of the web in a single coater. The coating method used can be selected among, e.g., different kinds of doctor coating methods, film transfer coating or spray coating methods. The method of drying, calendering and winding may be implemented in a desired manner, and the number of different units in the line can be varied. For instance, the number of coater stations, as well as the calender nips, may be increased to four. Obviously, calendering can also be omitted.

At the discontinuities between the support elements the web may be supported mechanically or by means of air jets, and the same means may also be used for guiding the edge strip during tail threading.

While the assembly according to the invention is principally intended for machines running at very high speeds, it can be used where desirable on a machine layout running at any speed range. Obviously, the assembly is also suited for use in off-machine layouts.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

I claim:

1. An apparatus for coating a paper web comprising:

a coater section for coating a paper web at an application zone;

a dryer section for drying the web coated in said coater section;

a first support means for supporting the web and for delivering the web to the coater section, said first support means having a support surface for supporting the web;

a second support means for receiving the web in the coater section from said first support means and for supporting the web through the application zone of the coater section, said second support means having a support surface for supporting the web;

a third support means for receiving the web from said second support means and for supporting the web through said dryer section, said third support means having a support surface for supporting the web;

means for urging the web against each of the support surfaces of said first, second and third support means; and a movable auxiliary support means positionable at a discontinuity in support of the web to provide supporting guidance to the web over the discontinuity of a tail of the web during tail threading of the web through the apparatus.

2. The apparatus of claim 1, wherein said first support means is positioned to transfer the web from said first support means to said second support means such that during such transfer support of the web is continuous.

3. The apparatus of claim 1, wherein said second support means is positioned to support a first side of the web, wherein said third support means is positioned to support the first side of the web, and wherein said third support means is positioned so that during transfer of the web from said second support means to said third support means a discontinuity is formed in support of the web where the web is unsupported.

4. The apparatus of claim 1, wherein said coater section comprises an air dryer for blowing air onto the web as the web passes by said air dryer and a dryer cylinder group, and said third support means comprises a predryer support means for supporting the web as the web passes by said air dryer, and an initial dryer support means for supporting the web through said dryer cylinder group.

5. The apparatus of claim 1, wherein said means for urging the web against the support surfaces of said first, second and third support means comprise at least one of a means for blowing air onto the web and a vacuum means for supporting adherence of the web to said support means by application of a vacuum.

6. The apparatus of claim 4 comprising at least two coater sections, a calender, a fourth support means and a winder, said second support means being positioned for receiving the web in a first coater section of said at least two coater sections said third support means being positioned to feed the web into a second coater section of said at least two coater sections, said calender being positioned to receive the web from the second coater section of said at least two coater sections, said winder being positioned to receive the web from said calender, and said fourth support means for supporting the web as the web is transferred from said calender to said winder.

7. The apparatus of claim 1, wherein said first support means is a wire of a paper machine.

8. The apparatus of claim 1, wherein said first support means is a support wire of an unwinder.

9. The apparatus of claim 1, further comprising a spreader device positioned to act upon at least one of said first, second and third support means for spreading said at least one of said support means so that the web is supported by said at least one of said support means.

10. An apparatus for coating a paper web comprising:

a coater section for coating a paper web at an application zone;

a dryer section for drying the web coated in said coater section;

a first support means for supporting the web and for delivering the web to the coater section, said first support means having a support surface for supporting the web;

a second support means for receiving the web in the coater section from said first support means and for supporting the web through the application zone of the coater section, said second support means having a support surface for supporting the web;

a third support means for receiving the web from said second support means and for supporting the web through said dryer section, said third support means having a support surface for supporting the web;

means for urging the web against each of the support surfaces of said first, second and third support means; and a means for forming an air jet at a discontinuity in support of the web to provide supporting guidance of the web over the discontinuity of a tail of the web during tail threading of the web through the apparatus.

11. The apparatus of claim 10, wherein said first support means is positioned to transfer the web from said first support means to said second support means such that during such transfer support of the web is continuous.

12. The apparatus of claim 10, wherein said second support means is positioned to support a first side of the web, wherein said third support means is positioned to support the first side of the web, and wherein said third support means is positioned so that during transfer of the web from said second support means to said third support means a discontinuity is formed in support of the web where the web is unsupported.

13. The apparatus of claim 10, wherein said coater section comprises an air dryer for blowing air onto the web as the web passes by said air dryer and a dryer cylinder group, and said third support means comprises a predryer support means for supporting the web as the web passes by said air dryer, and an initial dryer support means for supporting the web through said dryer cylinder group.

14. The apparatus of claim 10, wherein said means for urging the web against the support surfaces of said first, second and third support means comprise at least one of a means for blowing air onto the web and a vacuum means for supporting adherence of the web to said support means by application of a vacuum.

15. The apparatus of claim 13 comprising at least two coater sections, a calender, a fourth support means and a winder, said second support means being positioned for receiving the web in a first coater section of said at least two coater sections said third support means being positioned to feed the web into a second coater section of said at least two coater sections, said calender being positioned to receive the web from the second coater section of said at least two coater sections, said winder being positioned to receive the web from said calender, and said fourth support means for supporting the web as the web is transferred from said calender to a said winder.

16. The apparatus of claim 10, wherein said first support means is a wire of a paper machine.

17. The apparatus of claim 10, wherein said first support means is a support wire of an unwinder.

18. The apparatus of claim 10, further comprising a spreader device positioned to act upon at least one of said first, second and third support means for spreading said at least one of said support means so that the web is supported by said at least one of said support means.

19. A method of threading a tail of a paper web to be coated through a coating line during startup or after web breakage, comprising:

slitting the web at an edge to effect an edge strip to act as a tail of the web;

guiding the edge strip in a travel direction of the web over a first movable support means having a width substantially equal to a width of the web to a second movable support means having a width substantially equal to a width of the web, the second movable support means being located downstream of the first movable support means in the travel direction of the web, the first movable support means being separated from the second movable support means by a discontinuity at which the web is unsupported by either of the first and the second movable support means;

causing the edge strip to be supported against the first and second movable support means;

moving an auxiliary support means to the discontinuity;

guiding the edge strip with the auxiliary support means so that the edge strip travels across the discontinuity from the first movable support means to the second movable support means; and widening the width of the web after the edge strip has travelled across the discontinuity from the first movable support means to the second movable support means.

20. The method of claim 19, further comprising removing the auxiliary support means from the discontinuity after the edge strip has travelled across the discontinuity.

* * * * *